US008105251B1

(12) United States Patent
Wu

(10) Patent No.: US 8,105,251 B1
(45) Date of Patent: Jan. 31, 2012

(54) MASSAGING DEVICE THAT CAN BE USED TO MASSAGE TWO DIFFERENT POSITIONS OF A USER'S BODY

(76) Inventor: Dong-Her Wu, Chang Hua Hsien (TW)

( * ) Notice: Subject to any disclaimer, the term of this patent is extended or adjusted under 35 U.S.C. 154(b) by 985 days.

(21) Appl. No.: 12/053,171

(22) Filed: Mar. 21, 2008

(51) Int. Cl.
*A61H 5/00* (2006.01)

(52) U.S. Cl. ..... 601/84; 601/97; 601/99; 601/108; 601/112

(58) Field of Classification Search ..... 601/84, 601/86, 87, 89, 90, 92, 93, 94, 97, 98, 100–104, 601/107, 108, 110–113, 116, 134
See application file for complete search history.

(56) References Cited

U.S. PATENT DOCUMENTS 7,128,722 B2 * 10/2006 Lev et al. ..... 601/108
2005/0256434 A1 * 11/2005 Luo ..... 601/86
2006/0069328 A1 * 3/2006 Huang ..... 601/70

* cited by examiner

*Primary Examiner* — Quang D Thanh
(74) *Attorney, Agent, or Firm* — Alan Kamrath; Kamrath IP Lawfirm, PA

(57) ABSTRACT

A massaging device includes a drive mechanism, two rotation shafts mounted on and rotated by the drive mechanism, two eccentric members each having a first end mounted on a respective rotation shaft and a second end provided with an eccentric shaft, and two massaging members each mounted on the eccentric shaft of respective eccentric member. Thus, the two massaging members can be used to massage two different positions of a user's body. In addition, the massaging device is provided with two reduction gears to increase the torque of the drive mechanism to the two rotation shafts, so that the two rotation shafts are driven by the drive mechanism to drive the two massaging members and easily and conveniently.

15 Claims, 8 Drawing Sheets

MASSAGING DEVICE THAT CAN BE USED TO MASSAGE TWO DIFFERENT POSITIONS OF A USER'S BODY

BACKGROUND OF THE INVENTION

1. Field of the Invention

The present invention relates to a massaging device and, more particularly, to a massaging device to provide a massaging effect to a user.

2. Description of the Related Art

A conventional massaging device comprises a drive member (such as a motor), a rotation shaft mounted on the drive member, a gear unit mounted in the drive member and connected with the rotation shaft to rotate the rotation shaft, an eccentric member mounted on and rotated by the rotation shaft, and a massaging member mounted on the eccentric member to move with the eccentric member. In operation, when the rotation shaft is rotated, the eccentric member is rotated eccentrically to drive the massaging member to move and rotate relative to a user's body so as to massage the user's body. However, the massaging member can be used to massage a single position of the user's body, thereby limiting the versatility of the massaging device.

BRIEF SUMMARY OF THE INVENTION

In accordance with the present invention, there is provided a massaging device, comprising a drive mechanism, two rotation shafts mounted on and rotated by the drive mechanism, two eccentric members each having a first end mounted on a respective one of the two rotation shafts to rotate with the respective rotation shaft and each having a second end provided with an eccentric shaft, and two massaging members each mounted on the eccentric shaft of a respective one of the two eccentric members to move with the eccentric shaft of the respective eccentric member.

The massaging device further comprises two one-way bearings each mounted between a respective one of the two rotation shafts and a respective one of the two eccentric members.

The massaging device further comprises two reduction gears mounted on the drive mechanism and each connected with a respective one of the two rotation shafts to increase a torque of the drive mechanism to the respective rotation shaft.

The primary objective of the present invention is to provide a massaging device that can be used to massage two different positions of a user's body.

Another objective of the present invention is to provide a massaging device, wherein when a user's body abuts the two massaging members, the two rotation shafts are rotated by the drive mechanism to drive one of the two massaging members by provision of the two one-way bearings so as to massage two different positions of the user's body by the two massaging members, thereby greatly enhancing the massaging effect of the massaging device, and thereby providing comfortable sensation to the user.

A further objective of the present invention is to provide a massaging device, wherein the massaging device is provided with two reduction gears to increase the torque of the drive mechanism to the two rotation shafts, so that the two rotation shafts are driven by the drive mechanism to drive the two massaging members and easily and conveniently, thereby facilitating operation of the massaging device.

Further benefits and advantages of the present invention will become apparent after a careful reading of the detailed description with appropriate reference to the accompanying drawings.

BRIEF DESCRIPTION OF THE SEVERAL VIEWS OF THE DRAWING(S)

DETAILED DESCRIPTION OF THE INVENTION

Figure 1:
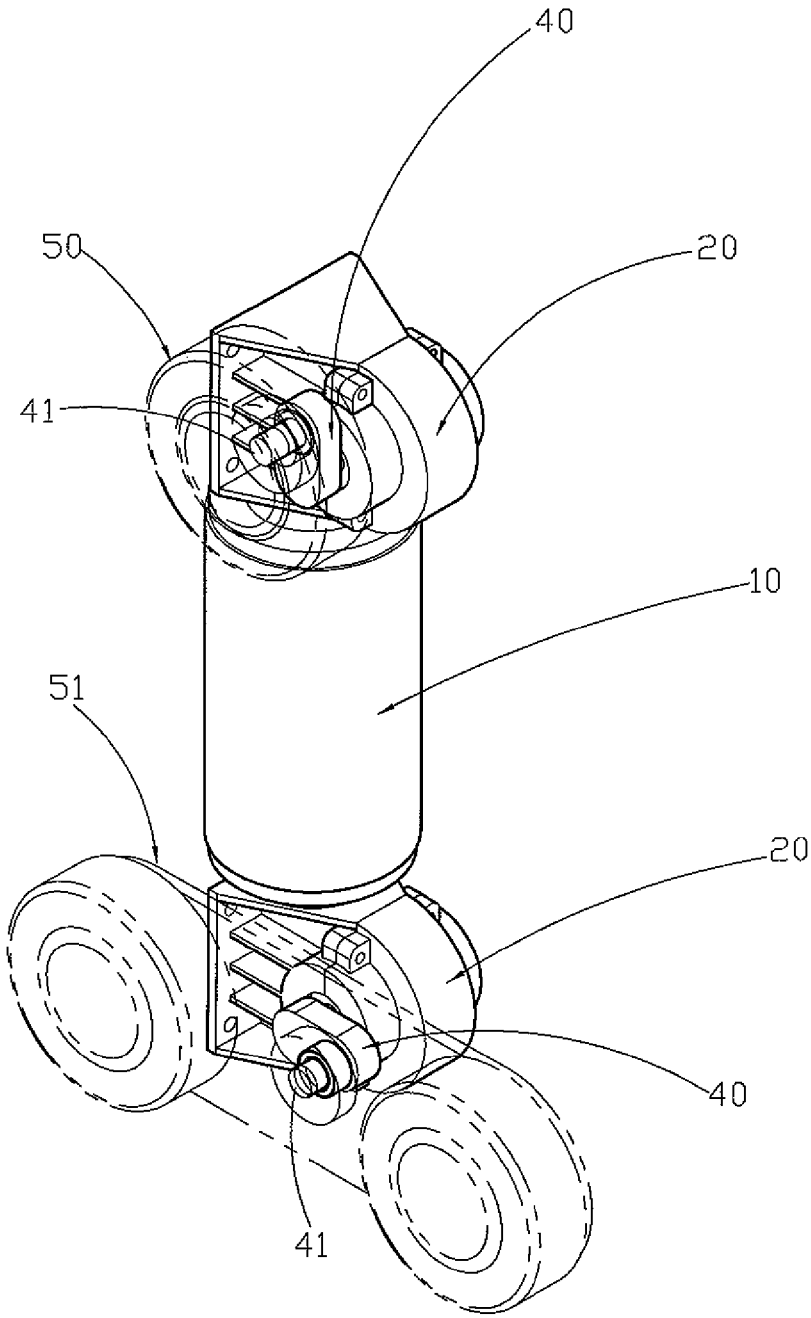
FIG. 1 is a perspective view of a massaging device in accordance with the preferred embodiment of the present invention.
Figures 2, 2A:
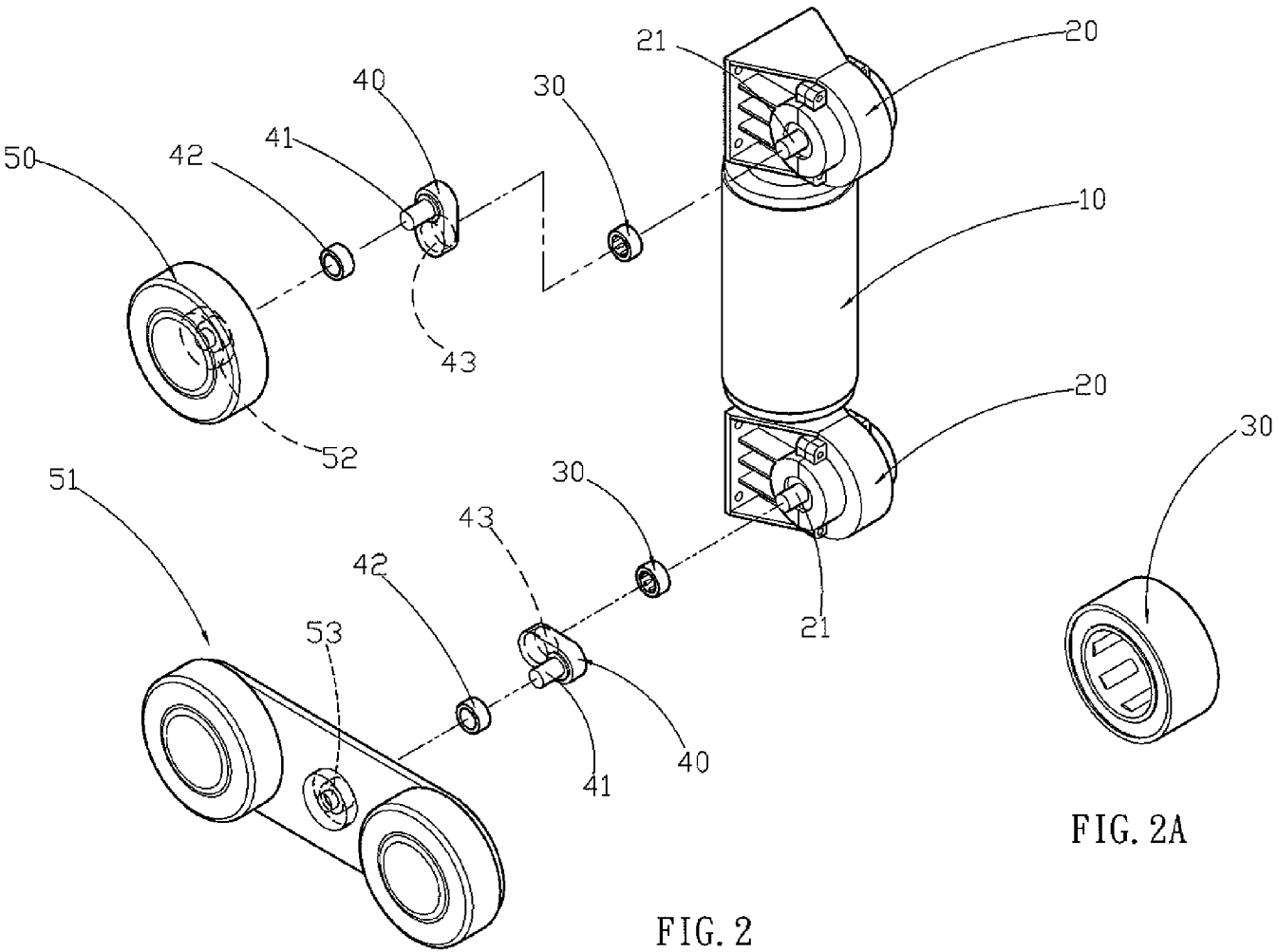
FIG. 2 is an exploded perspective view of the massaging device as shown in FIG. 1.
FIG. 2A is a locally enlarged view of a one-way bearing of the massaging device as shown in FIG. 2.
Figure 3:
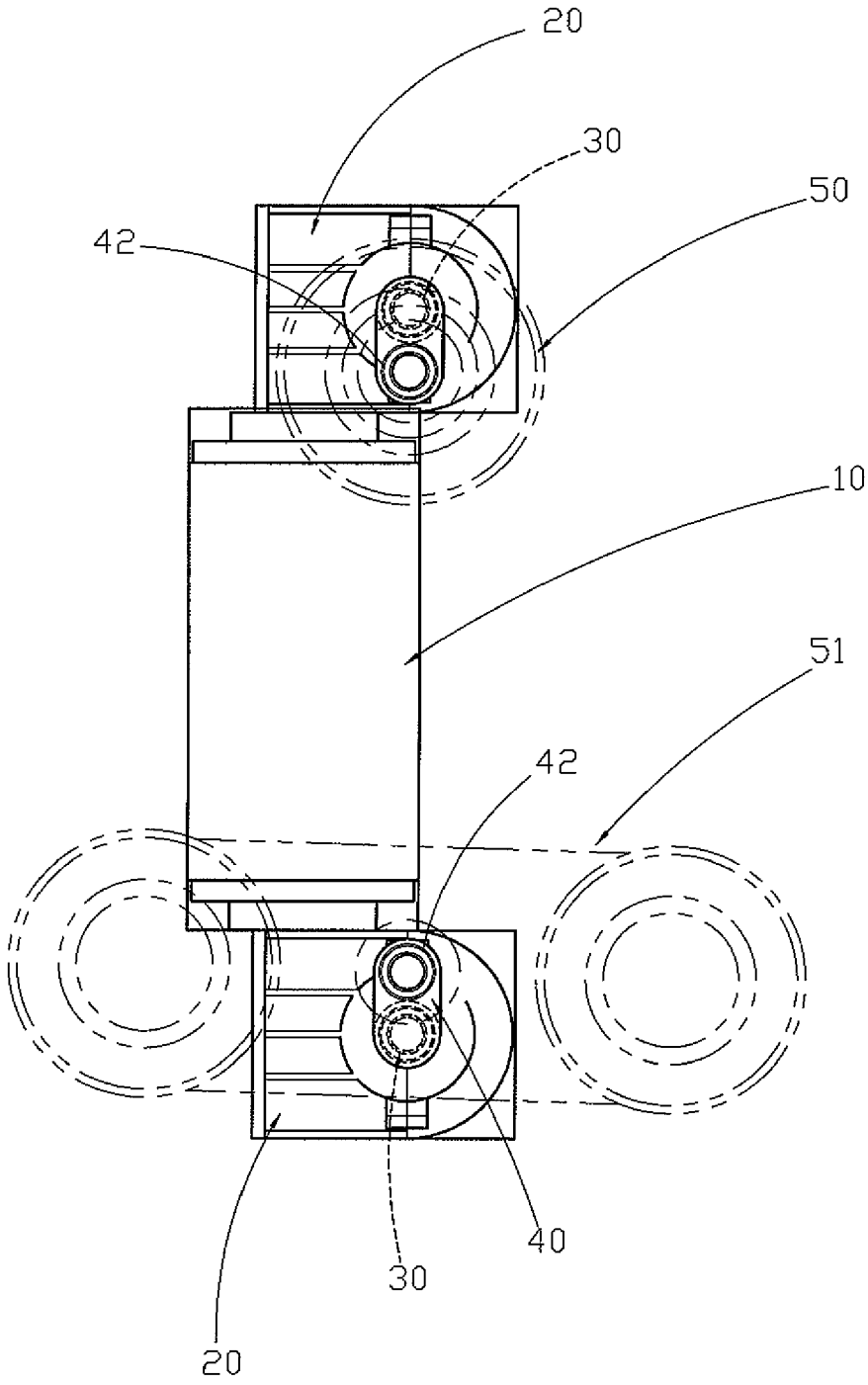
FIG. 3 is a front view of the massaging device as shown in FIG. 1.
Figure 4:
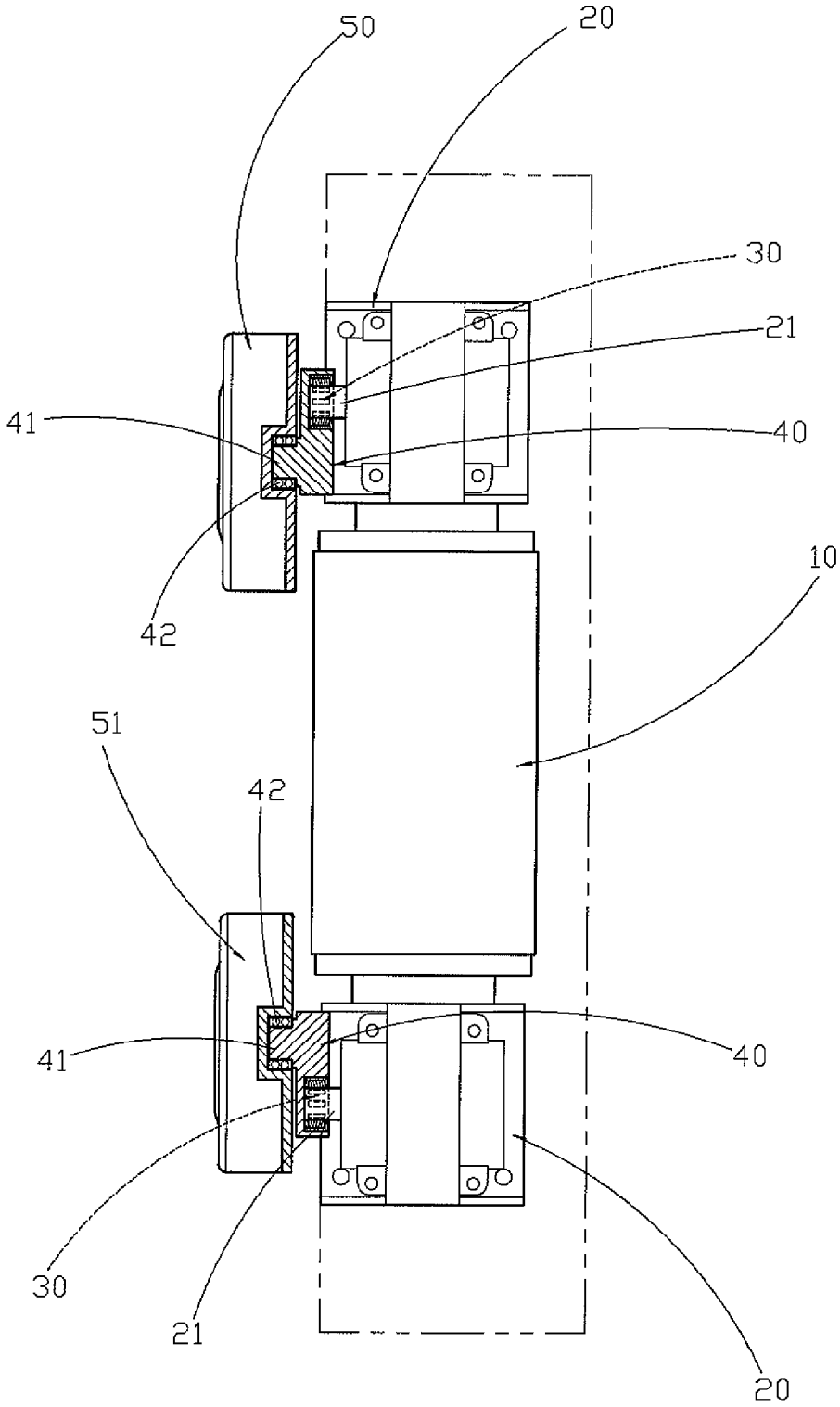
FIG. 4 is a side cross-sectional view of the massaging device as shown in FIG. 1.

Referring to the drawings and initially to FIGS. 1-4, a massaging device in accordance with the preferred embodiment of the present invention comprises a drive mechanism 10, two rotation shafts 21 mounted on and rotated by the drive mechanism 10, two reduction gears 20 mounted on the drive mechanism 10 and each connected with a respective one of the two rotation shafts 21 to increase a torque of the drive mechanism 10 to the respective rotation shaft 21, two eccentric members 40 each having a first end mounted on a respective one of the two rotation shafts 21 to rotate with the respective rotation shaft 21 and each having a second end provided with an eccentric shaft 41, two one-way bearings 30 (shown clearly in FIG. 2A) each mounted between a respective one of the two rotation shafts 21 and a respective one of the two eccentric members 40, two massaging members 50 and 51 each mounted on the eccentric shaft 41 of a respective one of the two eccentric members 40 to move with the eccentric shaft 41 of the respective eccentric member 40, and two bearings 42 each mounted between a respective one of the two massaging members 50 and 51 and the eccentric shaft 41 of a respective one of the two eccentric members 40.

The drive mechanism 10 is a bidirectional motor to drive and rotate the two rotation shafts 21 simultaneously so that the two rotation shafts 21 are rotatable clockwise and counterclockwise.

The two rotation shafts 21 are located at two opposite ends of the drive mechanism 10 and are driven by the drive mechanism 10 to rotate in the same direction simultaneously.

Each of the two one-way bearings 30 is driven by the respective rotation shaft 21 in one direction only so that each of the two eccentric members 40 and the respective one-way bearing 30 are rotatable with the respective rotation shaft 21 in one direction only. The two one-way bearings 30 are rotatable relative to the drive mechanism 10 in two different directions. Thus, when each of the two rotation shafts 21 is rotated clockwise, a first one of the two one-way bearings 30 is rotatable clockwise with the respective rotation shaft 21, and a second one of the two one-way bearings 30 idles and stops rotating. On the contrary, when each of the two rotation shafts 21 is rotated counterclockwise, the second one of the two one-way bearings 30 is rotatable counterclockwise with the respective rotation shaft 21, and the first one of the two one-way bearings 30 idles and stops rotating.

The first end of each of the two eccentric members 40 is rotatable with the respective one-way bearing 30 and the respective rotation shaft 21 and is provided with a mounting hole 43 for mounting the respective one-way bearing 30 and the respective rotation shaft 21. The eccentric shaft 41 of each of the two eccentric members 40 has an axial direction spaced from and parallel with that of the respective rotation shaft 21.

The two massaging members 50 and 51 are spaced from each other. Each of the two massaging members 50 and 51 is rotatably mounted on the eccentric shaft 41 of the respective eccentric member 40 by the respective bearing 42. Each of the two massaging members 50 and 51 has a middle portion provided with a driven hole 52 and 53 rotatably mounted on the respective bearing 42 and the eccentric shaft 41 of the respective eccentric member 40.

Figure 5:
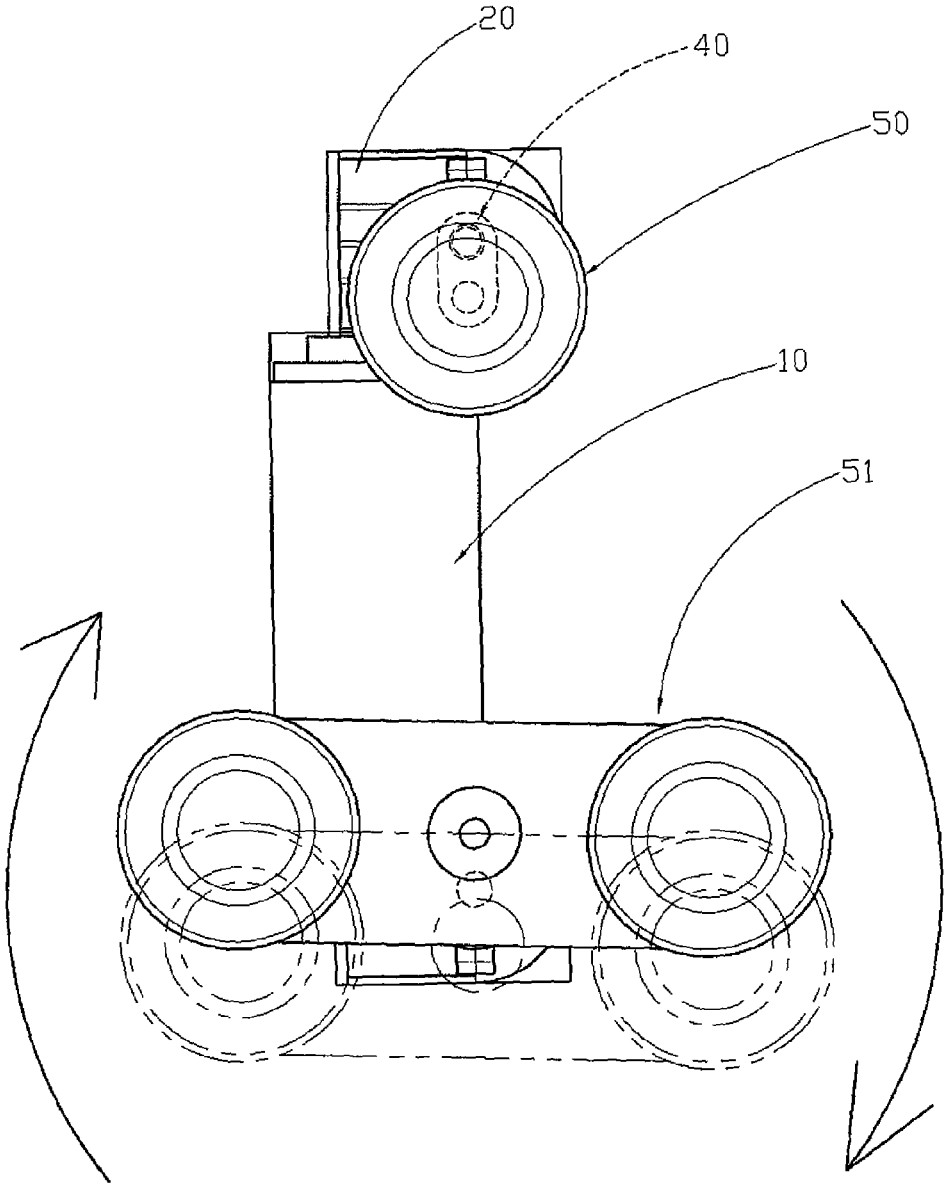
FIG. 5 is a schematic operational view of the massaging device as shown in FIG. 3.
Figure 6:
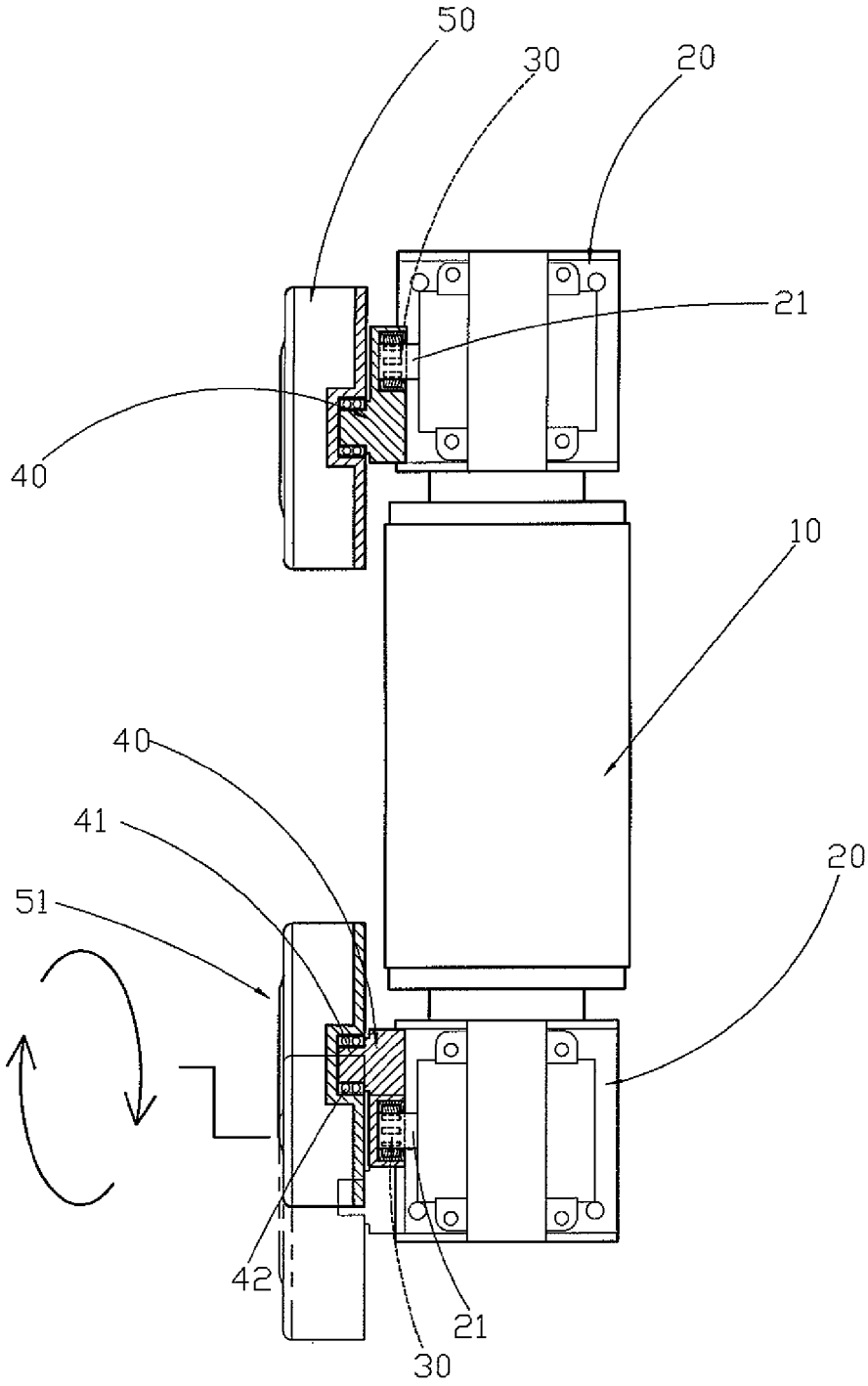
FIG. 6 is a schematic operational view of the massaging device as shown in FIG. 4.

In operation, referring to FIGS. 5 and 6 with reference to FIGS. 1-4, when each of the two rotation shafts 21 is rotated clockwise, the first (or lower) one of the two one-way bearings 30 is rotatable clockwise with the respective rotation shaft 21 to drive the first (or lower) one of the two eccentric members 40 to rotate clockwise in an eccentric manner and to drive and move the lower massaging member 51 in a reciprocal manner as shown in FIGS. 5 and 6 so as to massage a user's body. At the same time, the second (or upper) one of the two one-way bearings 30 stops rotating so that the second (or upper) one of the two eccentric members 40 stops rotating, and the upper massaging member 50 stops moving.

Figure 7:
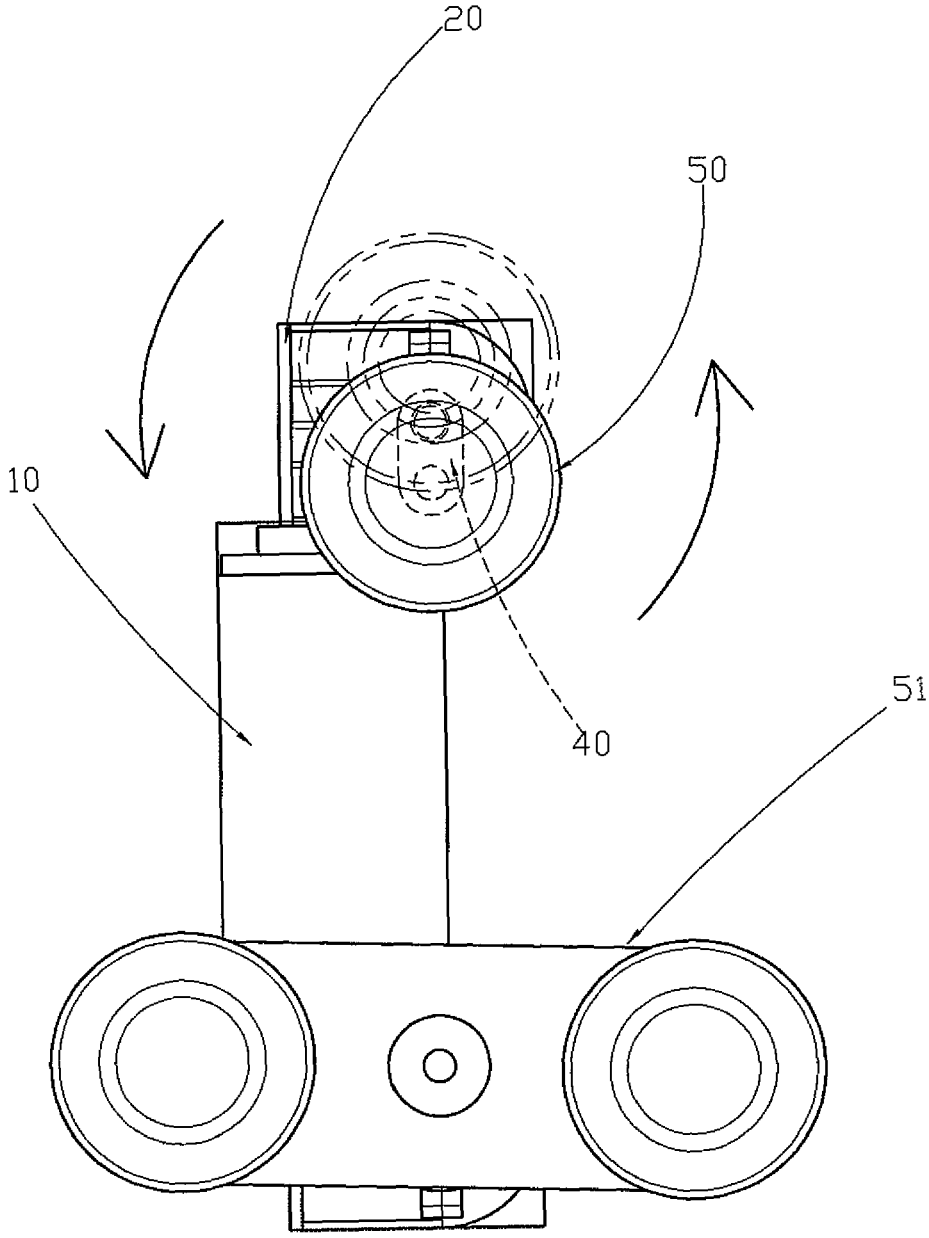
FIG. 7 is a schematic operational view of the massaging device as shown in FIG. 3.
Figure 8:
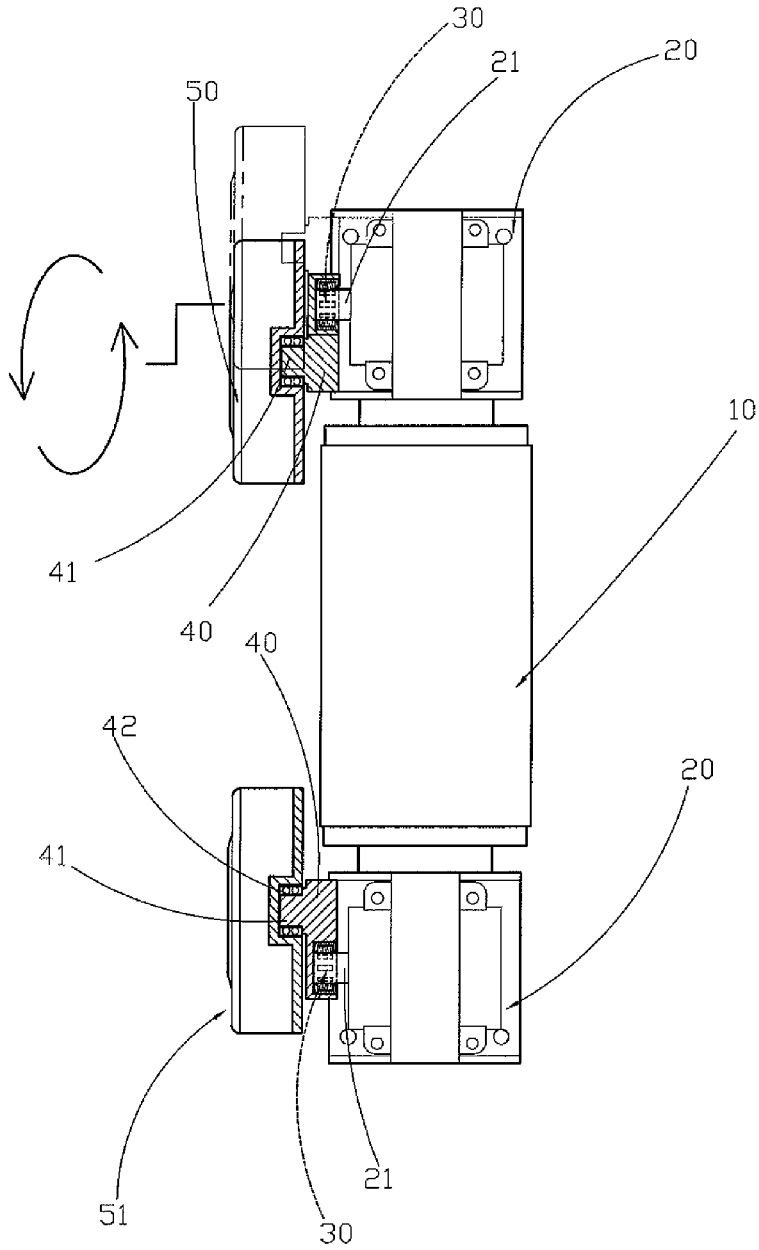
FIG. 8 is a schematic operational view of the massaging device as shown in FIG. 4.

On the contrary, referring to FIGS. 7 and 8 with reference to FIGS. 1-4, when each of the two rotation shafts 21 is rotated counterclockwise, the second (or upper) one of the two one-way bearings 30 is rotatable counterclockwise with the respective rotation shaft 21 to drive the second (or upper) one of the two eccentric members 40 to rotate counterclockwise in an eccentric manner and to drive and move the upper massaging member 50 in a reciprocal manner as shown in FIGS. 7 and 8 so as to massage the user's body. At the same time, the first (or lower) one of the two one-way bearings 30 stops rotating so that the first (or lower) one of the two eccentric members 40 stops rotating, and the lower massaging member 51 stops moving.

Accordingly, when a user's body abuts the two massaging members 50 and 51, the two rotation shafts 21 are rotated by the drive mechanism 10 to drive one of the two massaging members 50 and 51 by provision of the two one-way bearings 30 so as to massage two different positions of the user's body by the two massaging members 50 and 51, thereby greatly enhancing the massaging effect of the massaging device, and thereby providing comfortable sensation to the user. In addition, the massaging device is provided with two reduction gears 20 to increase the torque of the drive mechanism 10 to the two rotation shafts 21, so that the two rotation shafts 21 are driven by the drive mechanism 10 to drive the two massaging members 50 and 51 easily and conveniently, thereby facilitating operation of the massaging device.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

The invention claimed is:

1. A massaging device, comprising:

a drive mechanism;

two rotation shafts mounted on and rotated by the drive mechanism;

two eccentric members each having a first end mounted on a respective one of the two rotation shafts to rotate with the respective rotation shaft and each having a second end provided with an eccentric shaft;

two massaging members each mounted on the eccentric shaft of a respective one of the two eccentric members to move with the eccentric shaft of the respective eccentric member; and two one-way bearings each mounted between a respective one of the two rotation shafts and a respective one of the two eccentric members.

2. The massaging device in accordance with claim 1, further comprising:

two reduction gears mounted on the drive mechanism and each connected with a respective one of the two rotation shafts to increase a torque of the drive mechanism to the respective rotation shaft.

3. The massaging device in accordance with claim 1, wherein the drive mechanism is a bidirectional motor to drive and rotate the two rotation shafts simultaneously.

4. The massaging device in accordance with claim 1, wherein each of the two one-way bearings is driven by the respective rotation shaft in one direction only;

each of the two eccentric members and the respective one-way bearing are rotatable with the respective rotation shaft in one direction only.

5. The massaging device in accordance with claim 4, wherein the two one-way bearings are rotatable relative to the drive mechanism in two different directions.

6. The massaging device in accordance with claim 5, wherein when each of the two rotation shafts is rotated in a preset direction, one of the two one-way bearings is rotatable in the preset direction with the respective rotation shaft, and the other one of the two one-way bearings idles and stops rotating.

7. The massaging device in accordance with claim 1, wherein the two rotation shafts are located at two opposite ends of the drive mechanism.

8. The massaging device in accordance with claim 1, wherein the two rotation shafts are driven by the drive mechanism to rotate in the same direction simultaneously.

9. The massaging device in accordance with claim 1, wherein the first end of each of the two eccentric members is rotatable with the respective one-way bearing and the respective rotation shaft.

10. The massaging device in accordance with claim 9, wherein the first end of each of the two eccentric members is provided with a mounting hole for mounting the respective one-way bearing and the respective rotation shaft.

11. The massaging device in accordance with claim 1, wherein the eccentric shaft of each of the two eccentric members has an axial direction spaced from and parallel with that of the respective rotation shaft.

12. The massaging device in accordance with claim 1, wherein the two massaging members are spaced from each other.

13. The massaging device in accordance with claim 1, further comprising:

two bearings each mounted between a respective one of the two massaging members and the eccentric shaft of a respective one of the two eccentric members.

14. The massaging device in accordance with claim 13, wherein each of the two massaging members is rotatably mounted on the eccentric shaft of the respective eccentric member by the respective bearing.

15. The massaging device in accordance with claim 13, wherein each of the two massaging members has a middle portion provided with a driven hole rotatably mounted on the respective bearing and the eccentric shaft of the respective eccentric member.

* * * * *